US009936857B1

(12) United States Patent
Menius

(10) Patent No.: US 9,936,857 B1
(45) Date of Patent: Apr. 10, 2018

(54) ROLLER SWEEPER

(71) Applicant: Marvin L. Menius, Rockwell, NC (US)

(72) Inventor: Marvin L. Menius, Rockwell, NC (US)

( * ) Notice: Subject to any disclaimer, the term of this patent is extended or adjusted under 35 U.S.C. 154(b) by 0 days.

(21) Appl. No.: 15/641,693

(22) Filed: Jul. 5, 2017

(51) Int. Cl.
*A47L 25/00* (2006.01)
*B05C 17/02* (2006.01)

(52) U.S. Cl.
CPC ..... *A47L 25/005* (2013.01); *B05C 17/02* (2013.01); *B05C 17/0205* (2013.01); *B05C 17/0232* (2013.01)

(58) Field of Classification Search
CPC ... A47L 25/005; B05C 17/02; B05C 17/0205; B05C 17/0227; B05C 17/023; B05C 17/0232
USPC ..... 15/104.002, 230.11; 492/13, 19
See application file for complete search history.

(56) References Cited

U.S. PATENT DOCUMENTS 2,368,513 A * 1/1945 Adams ..... B05C 17/02 15/179
3,148,398 A 9/1964 Thomas
3,228,087 A * 1/1966 Stoddart ..... B05C 17/02 15/230.11
3,343,194 A * 9/1967 Ramelson ..... A47L 25/005 15/104.002
3,421,170 A * 1/1969 Thomas, Jr. ..... A47L 25/005 15/104.002
3,623,179 A * 11/1971 Roth ..... A47L 25/005 15/104.001
3,714,674 A 2/1973 Simoncioni
3,745,624 A 7/1973 Newman
3,970,396 A 7/1976 Brady
4,361,923 A * 12/1982 McKay ..... A47L 25/005 15/104.002
4,557,301 A 12/1985 Sartori
4,727,616 A * 3/1988 Kucera ..... A47L 25/005 15/104.002
5,533,223 A 7/1996 Ho
5,548,861 A 8/1996 Hukuba
5,584,092 A * 12/1996 Polzin ..... B05C 17/02 15/230.11
5,924,157 A 7/1999 Barela
6,014,788 A 1/2000 Jaffri
6,117,494 A 9/2000 Wakat
6,449,794 B1 9/2002 Jaffri
6,601,262 B2 8/2003 Janssen
6,685,609 B2 2/2004 Carder
7,281,288 B1 10/2007 McKay
7,487,566 B2 2/2009 McKay, Jr. et al.
7,559,108 B2 7/2009 Forte
(Continued)

FOREIGN PATENT DOCUMENTS

DE 9212647 * 12/1992
FR 1168672 * 12/1958
(Continued)

*Primary Examiner* — Mark Spisich
(74) *Attorney, Agent, or Firm* — Memminger E. Wiggins

(57) ABSTRACT

A roller sweeper comprising a handle, a detachable extension handle, a frame defining an axle, and a unitary cylindrical mounting member rotatably mounted on the axle. The unitary cylindrical mounting member is designed and configured such that an adhesive roller tube can be frictionally mounted thereon. Depending on the needs of a user, the roller sweeper may be used with or without the detachable extension handle.

16 Claims, 4 Drawing Sheets

(56) References Cited

U.S. PATENT DOCUMENTS

| | | | |
|---|---|---|---|
| 7,707,678 | B2 | 5/2010 | Major |
| 8,225,448 | B2 | 6/2012 | Vasitakes et al. |
| 8,510,894 | B2 | 8/2013 | Mrouse |
| 2001/0036513 | A1 | 11/2001 | Capoccia |
| 2002/0088070 | A1 | 7/2002 | Cho |
| 2002/0144367 | A1 | 10/2002 | McKay, Jr. |
| 2004/0134003 | A1 | 7/2004 | McKay, Jr. |
| 2005/0015910 | A1* | 1/2005 | Jordan ..... B05C 17/0205 15/230.11 |
| 2007/0163062 | A1 | 7/2007 | McKay |
| 2015/0313443 | A1 | 11/2015 | Kanai |
| 2016/0000298 | A1 | 1/2016 | Trunsky |

FOREIGN PATENT DOCUMENTS

| | | | |
|---|---|---|---|
| FR | 2272851 | * | 12/1975 |
| FR | 2881970 | * | 8/2006 |
| GB | 779911 | * | 7/1957 |
| GB | 2103470 | * | 2/1983 |
| JP | 8-24206 | * | 1/1996 |

* cited by examiner

ROLLER SWEEPER

FIELD OF THE INVENTION

The present invention relates to devices capable of cleaning a variety of surfaces and objects, including floors, chairs, sofas, beds, automobile seats and flooring, clothing, and the like. The mounting of an adhesive roller tube onto a unitary cylindrical mounting member provides a user the ability to remove dirt, hair, lint, and such other debris from numerous surfaces.

BACKGROUND OF THE INVENTION

Cleaning devices for household and light commercial uses are readily available at hardware stores and such other suppliers of these goods. Many such devices are configured to function as a hand-held roller cleaning device to which an extension handle may be attached to provide a user additional reach for cleaning surfaces that may not be within the user's arm's length.

One limitation of many roller cleaning devices is the number of parts of which the device is comprised. Such parts are prone to malfunction and breakage due to the use of sub-standard materials in the manufacturing of such devices. Additionally, hand-held roller cleaning devices with numerous and complex parts are often difficult to assemble, difficult to use, difficult to maintain, and costly to manufacture. Also, the inherit design and lack of durability regarding the components of many such devices do not support vigorous use when cleaning heavily soiled services.

Accordingly, there remains room for improvement and variation within the art.

SUMMARY OF THE INVENTION

It is at least one aspect of the present embodiments of the present invention to provide a roller sweeper comprising a minimum number of durable parts, such invention having a handle, a shank extending from the handle that is designed and configured to form a frame, an axle that is defined by the frame, a unitary cylindrical mounting member, a pair of positional washers, and an axle end cap.

It is at least one aspect of the present embodiments of the present invention to provide a handle having a plurality of longitudinally aligned concave dimples to provide a user comfort and additional grip.

It is at least one aspect of the present embodiments to provide an extension handle that can engage the handle to increase the distance at which the present invention may be used.

It is at least one aspect of the present embodiments to provide a unitary cylindrical mounting member that freely rotates about an axle, the unitary cylindrical mounting member having an inner end, an outer end, a longitudinal channel to receive the axle, a plurality of longitudinal ribs equiangular spaced around and radially extending from the channel to a unitary cylindrical mounting member surface, and an annular recess defined by the longitudinal ribs located at the outer end of said unitary cylindrical mounting member.

It is at least one aspect of the present embodiments to provide a unitary cylindrical mounting member surface to which an adhesive roller tube can be frictionally mounted when using the present invention for the removal of debris from a surface.

It is a further aspect of at least one of the present embodiments to provide a pair of opposing flanges at an inner end of the axle, the opposing flanges designed and configured to engage an inner positional washer that abuts against said inner end of the unitary cylindrical mounting member to maintain its position on the axle.

It is still a further aspect of at least one of the present embodiments to provide an axle having end outer end that is designed and configured to engage an outer positional washer and a detachable axle end cap such that the outer positional washer abuts against the outer end of the unitary cylindrical mounting member and the detachable axle end cap to maintain the position of the unitary cylindrical member on the axle.

It is at least one aspect of the present embodiments to provide a unitary cylindrical mounting member being manufactured from extruded plastic to provide product strength economic production.

It is at least one aspect of the present embodiments to provide unitary cylindrical mounting members and axles having lengths to accommodate mounting one or more adhesive roller tubes.

It is at least one aspect of the present embodiments to provide a shank manufactured from steel and having a diameter of about 5/16 inches.

It is at least one aspect of the present embodiments to provide a handle manufactured from plastic.

It is at least one aspect of the present embodiments to provide an extension handle manufactured from plastic.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
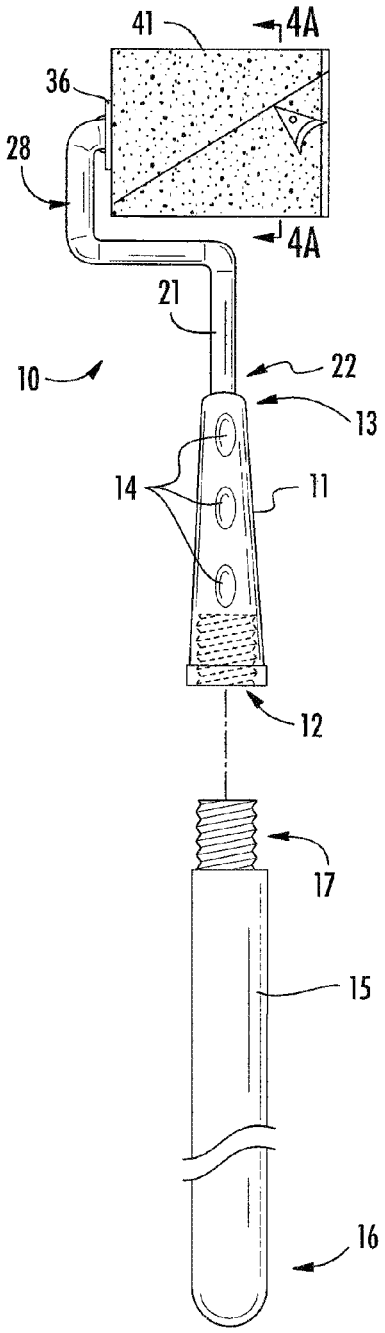
FIG. 1 is a top plan view of a preferred embodiment of the present invention.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention. Which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

As seen in reference to FIGS. 1 to 5B, a roller sweeper 10 is provided. In accordance with the present invention, a roller sweeper comprising a handle 11, an extension handle 15, a shank 21 designed and configured to form a frame 28, the frame defining an axle 24, and a unitary cylindrical mounting member 31. In preparation for use an adhesive roller tube 41, or such other similarly designed and configured cleaning attachment, can be frictionally mounted onto the unitary cylindrical mounting member 31 for the removal of debris from a surface. The roller sweeper 10 may be used with or without the extension handle 15 depending on the needs of a user.

Now referring to FIGS. 1, 2, 3A and 3B the present invention includes a handle 11 having a female threaded first end 12 and a second end 13 and an extension handle 15 having a first end 16 and a male threaded second end 17. The threaded second end 17 of the extension handle 15 is designed and configured to detachably engage the female threaded first end 12 of the handle 11 should a user need increased reach when using the roller sweeper. The longitudinally aligned plurality of concave dimples 14 on the handle 11, as well as the shape and size of the handle, provides a user additional grip and comfort when using the present invention. Additionally, a shank 21 extends longitudinally from the second end 13 of the handle 11 of the present invention forming a frame 28 having a proximal end 22 attached to the second end 13 of the handle 11, a distal end 23, a first bent portion 21A, a second bent portion 21B, and a third bent portion 21C. Now referring to specifically to FIGS. 3A and 3B, the shank 21 extends longitudinally from the second end 13 of the handle 11 to the first bent portion 21A of the frame 28 being perpendicular to said handle 11, said first bent portion of said frame 28 continuing to the second bent portion 21B of the frame 28 being parallel to said handle 11, said second bent portion 21B of said frame 28 continuing to the third bent portion 21C of the frame 28 being perpendicular to said handle 11, said, third bent portion 21C of said frame 28 continuing to said distal end 23 of said frame 28. The third bent portion of the frame 28 defines an, axle 24, said axle having an inner end 25 and an outer end 26, the outer end 26 of the axle 24 corresponding to the distal end 23 of the frame 28.

Referring, to FIGS. 2, 3A, 3B, 4A, 4B, to 4C, the present invention includes a unitary cylindrical mounting member 31 designed and configured to be rotatably mounted on the axle 24. The unitary cylindrical mounting member 31 comprising an inner end 39, an outer end 40, a longitudinal channel 32 having a diameter designed and configured to receive the axle 24, a plurality of longitudinal ribs 33 equiangular spaced around said longitudinal channel 32 and radially extending from said longitudinal channel 32 to a unitary cylindrical mounting member surface 34, and an annular recess 35 being defined by the longitudinal ribs 33 located at the outer end 40 of said unitary cylindrical mounting member 31. The unitary cylindrical mounting member surface 34 is designed and configured to frictionally receive an adhesive roller tube 41 including an adhesive layer 42, or such other similarly designed cleaning attachment.

Now referring to FIGS. 2, 3A, 3B, 4B, and 4C, in order to maintain the proper alignment of the unitary cylindrical mounting member 31 on the axle 24 the present invention incorporates a pair of opposing flanges 27 located at the inner end 25 of the axle 24, an inner positional washer 36, an outer positional washer 37, and an axle end cap 38. The inner positional washer 36 and the outer positional washer 37 comprising thrust washers to minimize drag produced between the positional washers and the rotation of the unitary cylindrical member. The axle end cap 38 comprising lock washers, push nuts, and cap nuts. The pair of opposing flanges 27 is located at the inner end 25 of the axle 24 and are designed and configured to engage the inner positional washer 36 thereby preventing the inner positional washer 36 from moving to the second bent portion 21B of the frame 28. The inner positional washer 36 abuts against the inner end 39 of the unitary cylindrical mounting member 31 to prevent movement of the unitary cylindrical mounting member towards the second bent portion 21B of the frame 28. The outer positional washer 37 is designed and configured to engage the outer end 26 of the axle 24 and to abut against the outer end 40 of the unitary cylindrical mounting member 31. The axle end cap 38 is designed and configured to engage the outer end 26 of the axle 24 and to abut against the outer positional washer 37 and thereby preventing the unitary cylindrical mounting member 31 from sliding off the roller sweeper axle 24. The annular recess 35 of the unitary cylindrical mounting member 31 having a depth and a diameter sufficient to house the outer positional washer 37 and axle end cap 38 so that the outer positional washer and the axle end cap when mounted on the outer end of the axle do not extend beyond the outer end 40 of the unitary cylindrical mounting member 31.

Figure 2:
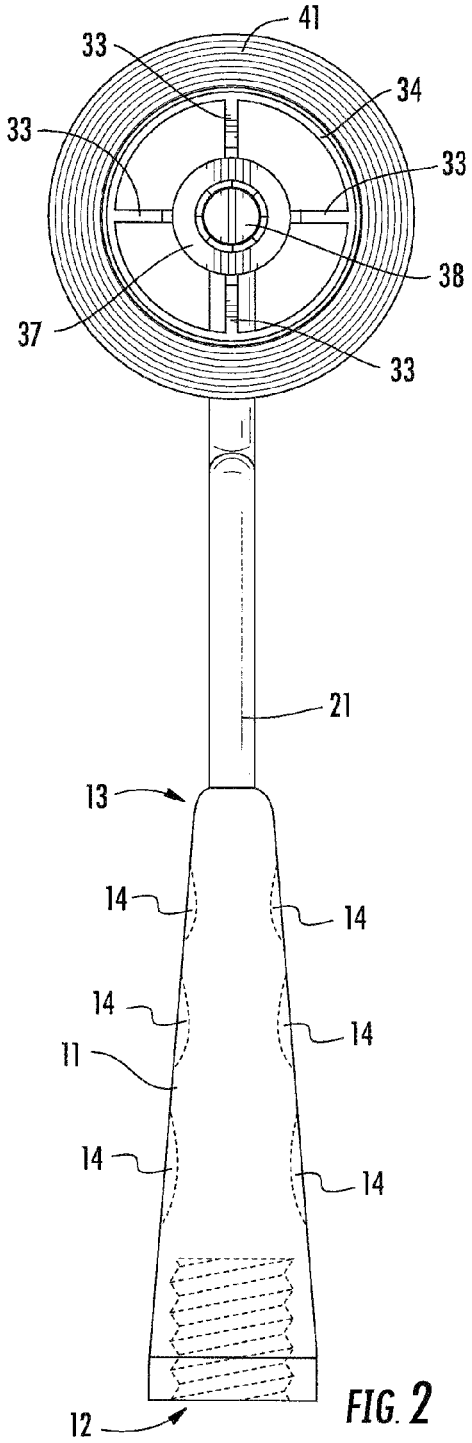
FIG. 2 is a side view of a preferred embodiment of the present invention.
Figure 3A:
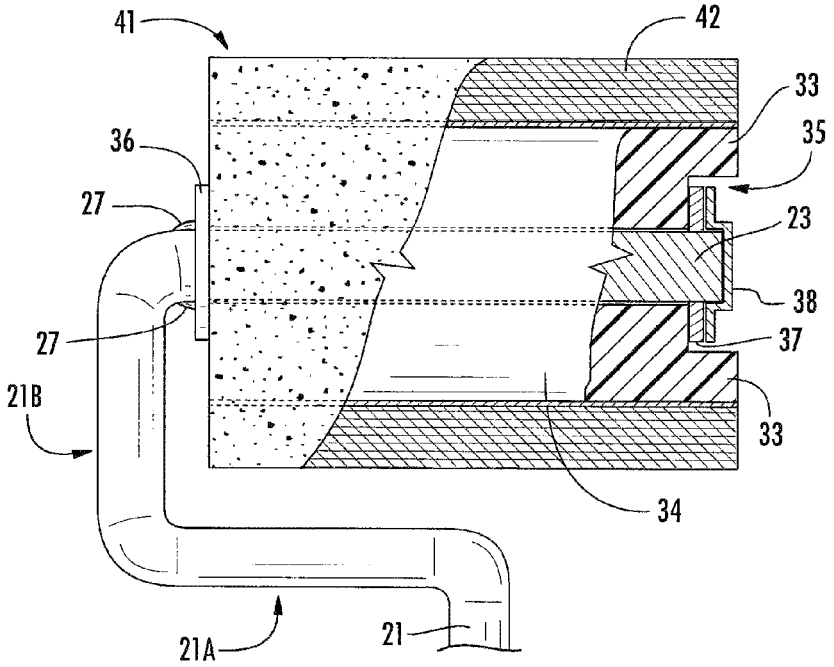
FIG. 3A is partial longitudinal cross sectional view of a unitary cylindrical mounting member with an adhesive roller tube mounted thereon.
Figure 3B:
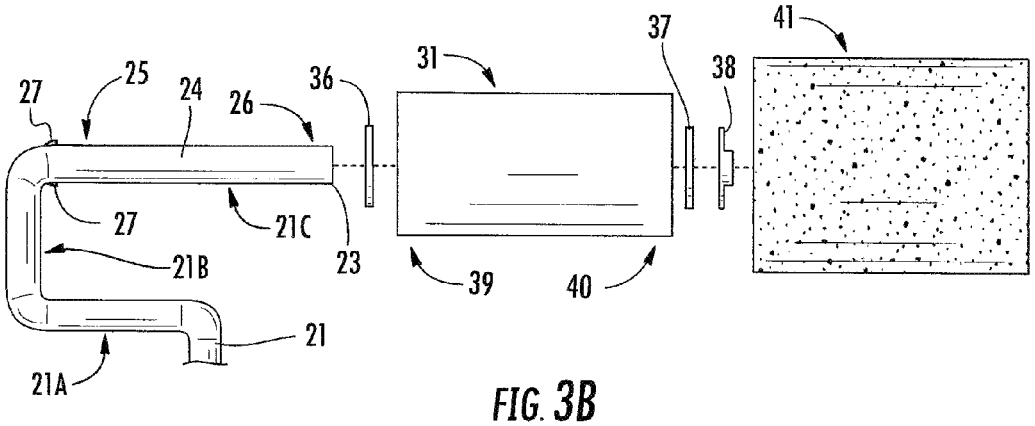
FIG. 3B is an exploded view of the present invention illustrating an axle relative to a unitary cylindrical mounting member and an adhesive roller tube mounted on the unitary cylindrical mounting member.
Figure 4A:
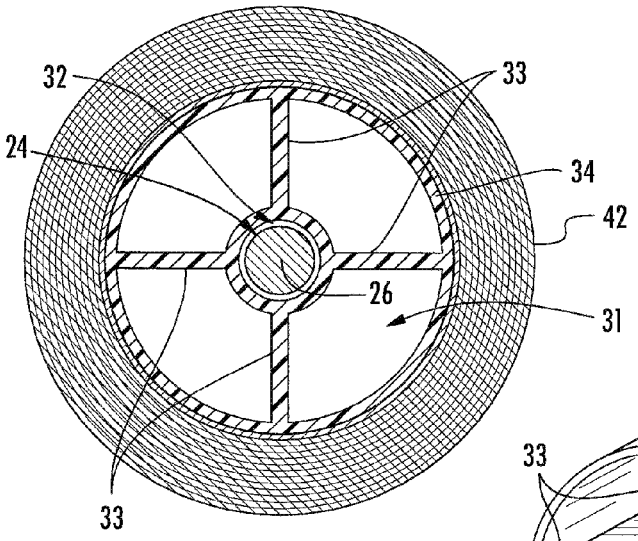
FIG. 4A is a transverse cross sectional view of a unitary cylindrical mounting member having an adhesive roller tube mounted thereon along line 4A of FIG. 1.
Figure 4B:
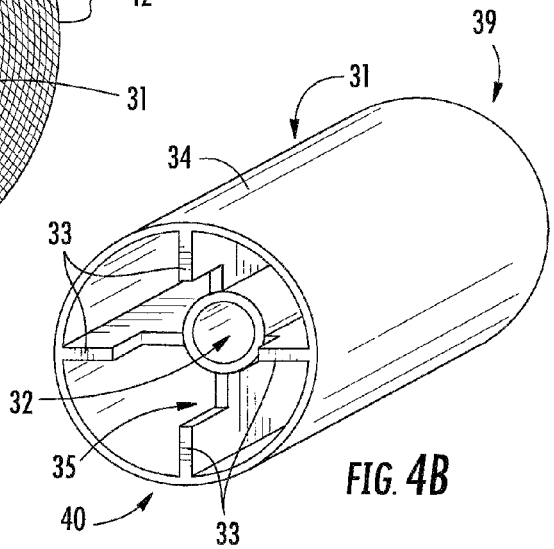
FIG. 4B is a perspective view of a unitary cylindrical mounting member.
Figure 4C:
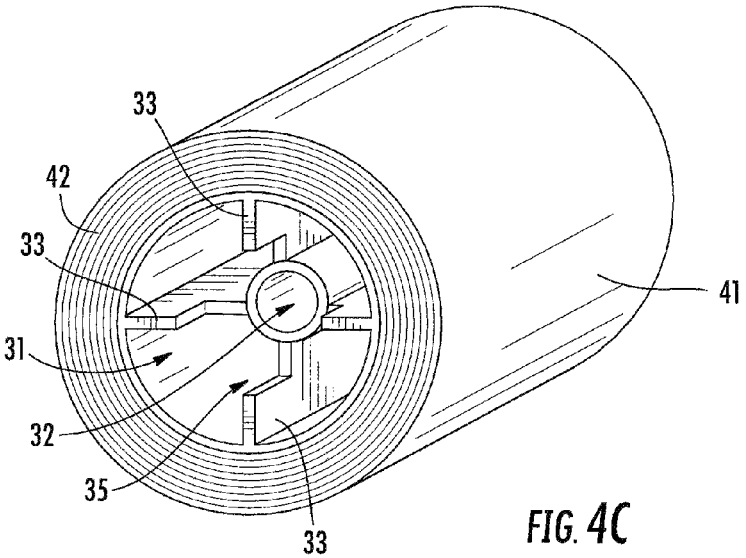
FIG. 4C is a perspective view of a unitary cylindrical mounting member with an adhesive roller tube mounted thereon.
Figure 5A:
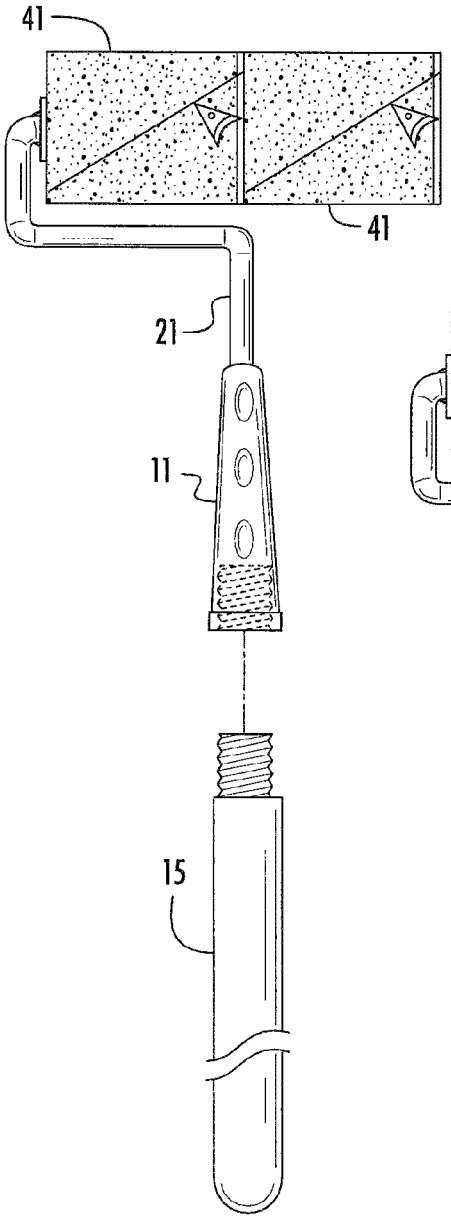
FIG. 5A is a top plan view of an alternative embodiment of the present invention illustrating two adhesive roller tubes mounted onto a unitary cylindrical mounting member.
Figure 5B:
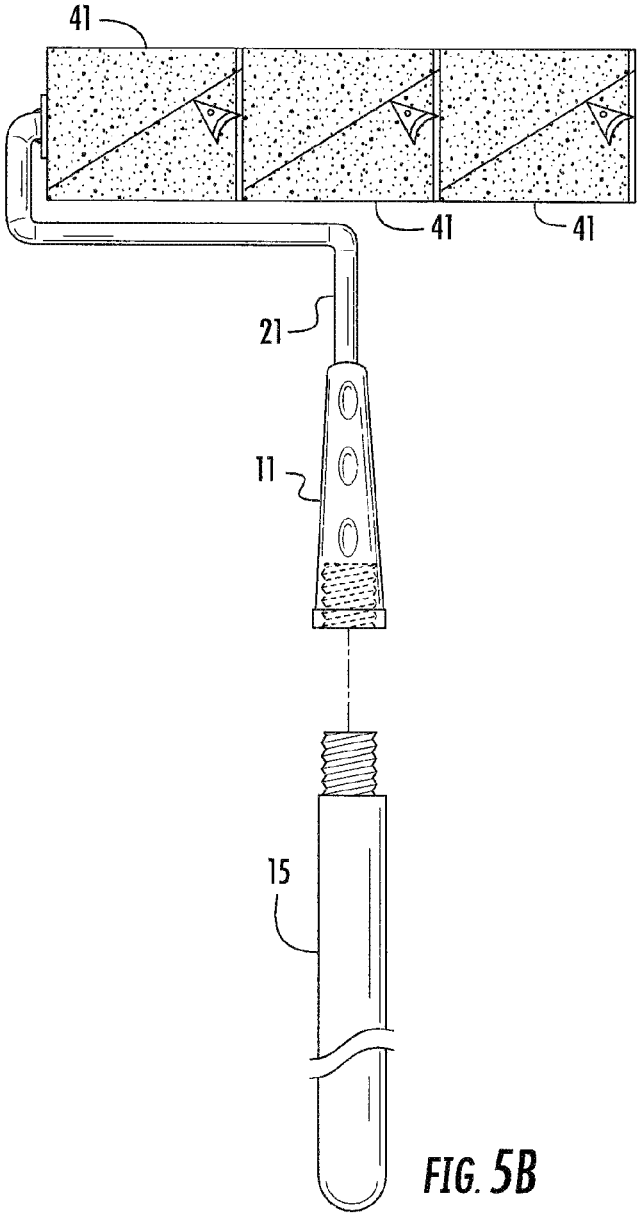
FIG. 5B is a top plan view of an alternative embodiment of the present invention illustrating three adhesive roller tubes mounted onto a unitary cylindrical mounting member.

The design and configuration of the present invention provides that the invention may be easily manufactured with unitary cylindrical mounting members and axles of different lengths. A preferred embodiment of the present invention is illustrated in FIGS. 1 and 2 depicting the invention having an axle length and a unitary cylindrical mounting member length to accommodate a single 3-inch adhesive roller tube frictionally mounted on the unitary cylindrical mounting member surface. As shown in FIGS. 5A and 5B, alternative embodiments of the present invention are illustrated in which the axle lengths and the unitary cylindrical mounting member lengths accommodate two 3-inch adhesive roller tubes and three 3-inch adhesive roller tubes mounted end to end on the unitary cylindrical mounting members. Additionally, other embodiments of the present invention may include other kinds of cleaning attachments which have been designed and configured to operate in a cylindrical tubular form capable of being mounted onto the unitary cylindrical mounting member of the present invention.

The unique design and configuration unitary cylindrical mounting member of the present invention permit the invention to be easily assembled and operated. To assemble the roller sweeper the inner positional washer is placed onto the axle and moved to a position adjacent to the pair of opposing flanges at the inner end of the axle. Next, the unitary cylindrical mounting member is slid onto the axle by inserting the outer end of the axle into the longitudinal channel located at the inner end of the unitary cylindrical mounting member. Once the unitary cylindrical mounting member is positioned onto the axle, the outer positional washer is placed onto the axle and moved to its position abutting the outer end of the unitary cylindrical mounting member. The axle end cap is next snapped onto the outer end of the axle putting it into position to abut against the outer positional washer thereby keeping the unitary cylindrical mounting member in position on the axle and preventing the unitary cylindrical mounting member from sliding off the axle when the present invention is in use. In a preferred embodiment of the present invention the distal end of the axle together with the axle end cap attached are housed within the annular recess to permit the roller sweeper's use directly against a wall, furniture, or the like. In a preferred embodiment of the present invention a user slides an adhesive cylindrical tube onto the unitary cylindrical mounting member such that the surface of the unitary cylindrical mounting member will frictionally engage the interior cylinder surface of the adhesive cylindrical tube. Once the adhesive cylindrical tube is mounted onto the unitary cylindrical mounting member, the user simply rolls the present invention across the surface to be cleaned. The detachable extension handle permits the user to operate the present invention close in hand or at a distance if needed with the extension handle attached to the handle.

In a preferred embodiment the unitary cylindrical mounting member being manufactured by plastics extrusion for strength and economy. Similarly, the handle and extension handle of the present invention is manufactured from plastic for strength and economy. The shank is manufactured from steel having a diameter of about 5/16 inches.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein.

That which is claimed:

1. A roller sweeper device comprising:

a handle having a female threaded first end and a second end;

an extension handle having a first end and a male threaded second end, said male threaded second end designed and configured to detachably engage said female threaded first end of said handle;

a shank extending longitudinally from said second end of said handle forming a frame having a proximal end and a distal end, said proximal end of the frame being attached to the second end of the handle, said frame terminating in a portion perpendicular to said handle at the distal end of said frame;

an axle being defined by said portion of the frame perpendicular to said handle at the distal end of said frame, said axle having an inner end and an outer end wherein said outer end corresponds to said distal end of said frame; and a unitary cylindrical mounting member designed and configured to be rotatably mounted on said axle, said cylindrical mounting member comprising an inner end, an outer end, a longitudinal channel designed and configured to receive said axle, a plurality of longitudinal ribs equiangular spaced around said channel and radially extending from said channel to a cylindrical mounting member surface, said unitary cylindrical mounting member surface designed and configured to frictionally receive an adhesive roller tube; and an annular recess defined by the longitudinal ribs located at the outer end of said unitary cylindrical mounting member.

2. The roller sweeper device of claim 1, wherein said handle includes a plurality of longitudinally aligned dimples to provide user comfort and additional grip.

3. The roller sweeper device of claim 1, wherein said inner end of said axle includes a pair of opposing flanges, said opposing flanges designed and configured to engage an inner positional washer, said inner positional washer abuts against said inner end of the unitary cylindrical mounting member to maintain the position of the inner end of the unitary cylindrical mounting member at the inner end of said axle.

4. The roller sweeper device of claim 3, wherein said inner positional washer comprising a thrust washer.

5. The roller sweeper device of claim 1, wherein said outer end of said axle being designed and configured to engage an outer positional washer and a detachable axle end cap, said outer positional washer abutting against the outer end of the cylindrical mounting member, the detachable axle end cap being designed and configured to maintain the position of the outer positional washer and the outer end of the unitary cylindrical mounting member at the outer end of said axle.

6. The roller sweeper device of claim 5, wherein said axle end cap being selected from a group consisting of lock washers, push nuts, and cap nuts.

7. The roller sweeper device of claim 1, wherein said unitary cylindrical mounting member being manufacture from extruded plastic.

8. The roller sweeper device of claim 1, wherein said shank is manufactured from steel.

9. The roller sweeper device of claim 1, wherein said handle and said extension handle are manufactured from plastic.

10. A roller sweeper device comprising:

a handle having a female threaded first end and a second end;

a shank attached to said handle forming a frame having a proximal end and a distal end, said proximal end of said frame extending longitudinally from the second end of the handle to a first bent portion of said frame being perpendicular to said handle, said first bent portion of said frame continuing to a second bent portion of said frame being parallel to said handle, said second bent portion of said frame continuing to a third bent portion of said frame being perpendicular to said handle, said third bent portion of said frame continuing to said distal end of said frame;

an axle being defined by said third bent portion of said frame, said axle having an inner end, an outer end, and a pair of opposing flanges located at the inner end of said axle;

a unitary cylindrical mounting member manufactured from extruded plastic designed and configured to be rotatably mounted on said axle, said cylindrical mounting member comprising an inner end, an outer end, a longitudinal channel having a diameter designed and configured to receive said axle, a plurality of longitudinal ribs equiangular spaced around said channel and radially extending from said channel to a cylindrical mounting member surface, said cylindrical mounting member surface designed and configured to frictionally receive an adhesive roller tube; and an annular recess defined by the longitudinal ribs located at the outer end of said cylindrical member;

an inner positional washer designed and configured to engage said pair of opposing flanges located at the inner end of said axle, said inner positional washer abuts against said inner end of the cylindrical member to maintain the position of the inner end of the unitary cylindrical mounting member at the inner end of said axle;

an outer positional washer designed and configured to abut against said outer end of said unitary cylindrical mounting member to maintain the position of the outer end of the unitary cylindrical mounting member at the outer end of said axle;

a detachable axle end cap designed and configured to engage said distal end of said shank and to secure said positional washers and said unitary cylindrical mounting member on said axle; and an extension handle having a first end and a male threaded second end, said male threaded second end designed and configured to detachably engage said female threaded first end of said handle.

11. The roller sweeper device of claim 10, wherein said handle includes a plurality of longitudinally aligned dimples to provide additional user comfort and grip.

12. The roller sweeper device of claim 10, wherein said annular recess of the unitary cylindrical mounting member having a depth and a diameter sufficient to house the outer positional washer and the axle end cap so that the outer positional washer and the axle end cap when mounted on the outer end of the axle do not extend beyond the outer end of the unitary cylindrical mounting member.

13. The roller sweeper device of claim 10, wherein said outer positional washer comprising a thrust washer.

14. The roller sweeper device of claim 10, wherein said axle end cap being selected from a group consisting of lock washers, push nuts, and cap nuts.

15. The roller sweeper device of claim 10, wherein said shank is manufactured from steel having a diameter of about 5/16 inch.

16. The roller sweeper device of claim 10, wherein said handle and said extension handle are manufactured from plastic.

* * * * *